US008157419B2

(12) United States Patent
Hand et al.

(10) Patent No.: US 8,157,419 B2
(45) Date of Patent: Apr. 17, 2012

(54) LED ASSEMBLY

(75) Inventors: Mark Anthony Hand, Covington, GA (US); Daniel Sekowski, Loganville, GA (US); Bernhard Bachl, Regensburg (DE); Olaf Cladders, Kamp-Lintfort (DE); Stefan Kwetkat, Moers (DE); Christian Miesner, Toenisvorst (DE)

(73) Assignee: ABL IP Holding LLC, Conyers, GA (US)

( * ) Notice: Subject to any disclaimer, the term of this patent is extended or adjusted under 35 U.S.C. 154(b) by 244 days.

(21) Appl. No.: 12/548,046

(22) Filed: Aug. 26, 2009

(65) Prior Publication Data

US 2011/0051423 A1 Mar. 3, 2011

(51) Int. Cl.
*F21V 29/00* (2006.01)

(52) U.S. Cl. ..... 362/294; 362/249.02; 362/373

(58) Field of Classification Search ..... 362/294, 362/373, 249.02, 547
See application file for complete search history.

(56) References Cited

U.S. PATENT DOCUMENTS 6,305,825 B1 * 10/2001 Okubo ..... 362/294
7,883,244 B2 * 2/2011 Hsu et al. ..... 362/362
7,950,829 B2 * 5/2011 Chiu et al. ..... 362/294
2007/0091598 A1 * 4/2007 Chen ..... 362/231
2009/0122570 A1 5/2009 Hsu et al.

FOREIGN PATENT DOCUMENTS

DE 10 2005 060 736 A1 7/2007
EP 1 898 146 A1 3/2008

OTHER PUBLICATIONS

International Application No. PCT/US2010/039736, International Search Report and Written Opinion mailed Oct. 6, 2010, 12 Pages.

* cited by examiner

*Primary Examiner* — John A Ward
(74) *Attorney, Agent, or Firm* — Kilpatrick Townsend & Stockton LLP

(57) ABSTRACT

An LED module or assembly is disclosed, the assembly having at least one LED component mounted on a support or circuit board and an optical element which encloses the at least one LED component and defines an interior space in which the at least one LED component is housed. A vent device is defined within the optical element for permitting gases generated from operation of the at least one LED component to be vented to atmosphere. The vent device prevents outside moisture from entering the interior space, but permits the gases to pass out to atmosphere for minimizing the likelihood of fogging of the optical elements in the interior space of the assembly.

16 Claims, 2 Drawing Sheets

LED ASSEMBLY

FIELD OF THE INVENTION

The invention relates to an LED module used for general illumination purposes.

BACKGROUND OF THE INVENTION

As known to those skilled in the art, LED modules used for illumination purposes, including general indoor as well as outdoor illumination, generally have a support structure, for example a circuit board with associated heat sink and mounting materials on which several LED components may be positioned, to include the chips, dies and optics, both primary and secondary, of the LED assembly. In order to protect the LED components from ambient environmental conditions in outdoor applications, the LED components are typically covered with optically transparent elements, which elements may also comprise the optics of the LED module.

It is desirable to ensure that the elements covering the LEDs are not adversely affected in their optical properties by either the high heat that results from LED operation or by other external influences, and of particular concern is the avoidance of any fogging or distortion of any and all materials positioned within the light path emanating from the LEDs in order to permit maximum light output and distribution to occur. It is known, however, that harmful gases can form in the LED modules during operation caused, for example, by the manufacturing flux residues or other resins used in or on the manufacture of the LED assembly, which may in turn lead to the fogging of plastics enclosing the LEDs, for example lenses and optics, especially those made of silicone materials. This effect is attributed, for example, to the cleavage of diphenyl groups. Also, and as known, the fogging of the lens/optics, and or other cover elements, can occur either due to thermal or photochemical reactions.

Accordingly, there is a need for an LED module adapted for use in outdoor applications which does not exhibit this fogging phenomena, even after periods of prolonged LED operation.

SUMMARY OF THE INVENTION

The present invention discloses an LED module having a support structure with at least one LED component mounted thereon. The LED component preferably comprises an electronic component used for light generation purposes, for example an LED die and/or chip assembly. The LED module may also comprise one or more light-emitting diodes or light-generating electronic structures.

An optically transparent cover, used to seal the LED module from the elements, is positioned over the LED component, or group of LED components, as desired. The cover spans an interior space and electrically insulates the LED components. Although an LED component by itself typically requires only low voltage power when in use, for example, 3V or 12V, the LED component may have a high potential relative to ground of several hundred volts. This is especially true when the LED module has numerous components connected in series. The cover over the LED components thus also provides the required electrical protection in this instance. If necessary and as desired, the cover can also be made of fire-retardant material.

The cover can also be designed to function as an optically-active element, for example, either as a lens, a diffusion lens to achieve light scattering or as a luminescence carrier or the like. The cover may be made from plastics such as Polymethyl Methacrylate, Polyurethane, Polycarbonate or others. The use of these plastics may result in the creation of a hermetic seal such that the entry of air and moisture into the interior space in which the LED component is positioned, or the emergence of gases from that encapsulated interior space is retarded or otherwise prevented.

The LED module preferably includes a vent device used to vent or otherwise release any harmful or performance limiting gases which may originate from the LED component and are captured within the interior space of the assembly by the cover/cover assembly. Those gases may, for example, emanate from solder contacts or flux residues present from the manufacture of the LED assembly, or otherwise be emitted by the LED into the interior space enclosed by the cover. The vent device is sized and shaped to prevent harmful gases accumulating within the interior space and being held therein which could otherwise lead to the fogging of the primary and/or secondary optics of the LED assembly, as described above. Moreover, these gases even if not directly harmful to the other materials and components within the interior space under the cover may increase the local atmospheric pressure within the covered space which in turn may result in harmful effects on the materials and components of the LED assembly.

Accordingly, the vent device is adapted to prevent harmful gases from accumulating within the interior space formed by the cover and attacking the silicone or other materials used to manufacture the LED component with a resultant fogging or discoloration of the cover and/or optics. The transparency of the primary lens or optic is thus not only maintained by this vent's presence, but will also retain its desired optical quality as well as avoiding any undesired scattering effects on the emitted light.

Additionally, the LED component is preferably encapsulated by a material which is at least partially transparent. For this purpose, the lens or transparent housing part of the LED component assembly may, for example, be made of an optically transparent silicone plastic which can be provided on or as a part of the encapsulation of the LED component. The primary encapsulation of the LED module can be both transparent (glass-clear) and opaque. The latter can be the case when the primary encapsulation has no lens function, but contains a phosphor. Alternatively the phosphor may placed between the primary transparent encapsulation and an LED chip.

The vent device preferably comprises at least one channel extended through the cover. This channel may be closed by an appropriate material which will be partially permeable. A silicone material, preferably an optical silicone, may be used in the vent device to seal the cover and prevent the passage of contaminants into the LED assembly. In a preferred embodiment, the refractive index of this optical silicone is adjusted to match the refractive index of the rest of the cover, so that the silicone-closed channel remains optically invisible and can therefore be positioned within the light path of the assembly if so desired.

Alternatively, the channel of the vent device may be positioned or otherwise formed in the side of the cover, outside of the main optical or light path. It is also possible to place the channel to the side of one cover next to one or more of the other covers in a series of covers such that the channel does not lie within the light path and each cover in the series is connected to the next via the channel. That series of covers can thus have a common vent channel as desired.

The LED component assembly of this invention takes into account the fact that the flux on the solder pads for the LED chips beneath the cover may be permitted to outgas continuously during operation of the LED module. The assembly also takes into account that the outgassing could possibly attack the optical silicone in the encapsulation beneath the primary lens and fog it, and suitable materials are thus described for this use. This harmful gas is also given an opportunity to escape the interior space of the encapsulated LED assembly. The vent device described for this purpose thus contains a channel filled with a silicone. In contrast to the material of the cover (Polyurethane or Polymethyl Methacrylate), however, silicone is permeable to the harmful gases.

BRIEF DESCRIPTION OF THE DRAWINGS

Practical examples of the invention are explained in the following drawings and the corresponding description thereof, below.

DETAILED DESCRIPTION

Figure 1:
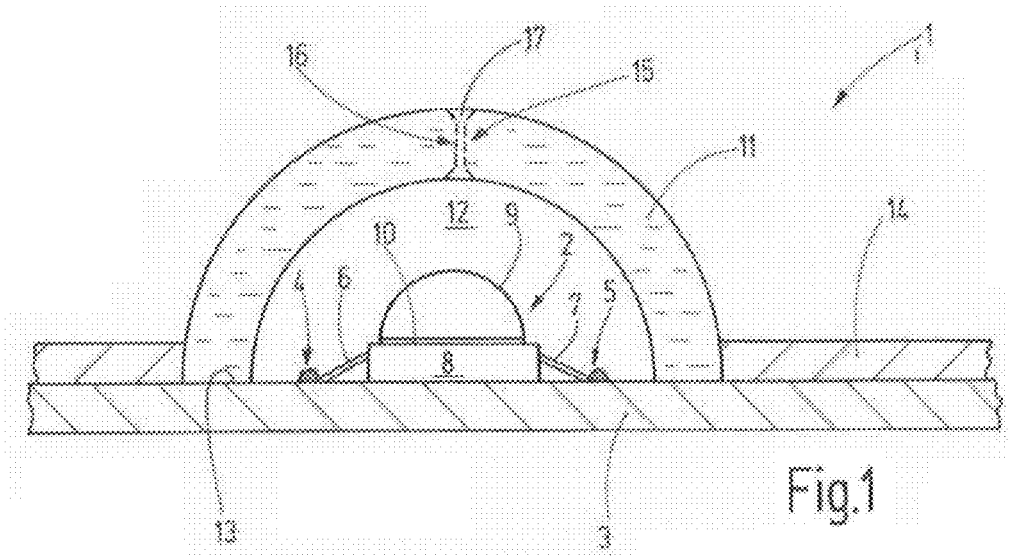
FIG. 1 is a partial cross-sectional side view of a first embodiment of the present invention around an LED component assembly.

Referring now in detail to the drawings, in which like reference numerals indicate similar parts throughout the views, preferred embodiments of the assembly and the novel vent devices of our invention are disclosed in FIGS. 1 through 6.

Referring now to FIG. 1, an LED module assembly 1 is shown in a partial cross-section, it being understood by those skilled in the art that the LED module assembly may be as long and as wide, with as many LEDs positioned thereon, as desired. It is anticipated, therefore, that the LED module assembly of FIG. 1 will have at least one, but may also have several, LED components 2. The LED component is arranged on a preferably flat, plate-like support 3, which serves, for example, as a heat spreader for heat removal away from the LED components. The support 3 can also be provided, on the side facing the LED component, with leads or traces that allow power supply to the LED component. A plurality of soldering sites 4, 5 connect the connection pins 6, 7 of the LED component to the leads or traces (not shown) on the support 3. In most embodiments the support 3 is a circuit board. The soldering sites 4, 5 may comprise a tin solder, for example. Residues of a flux, used to produce the soldering sites 4, 5, will typically be found on the soldering sites, the connection pins and/or or in the vicinity of the soldering sites.

The LED component 2 also has a housing 8 which houses a light-generating LED chip and permits light emergence from it's top side. The housing provides a primary encapsulation of the chip and can be constructed with a lens 9 on its base, which is referred to as the primary lens or optic. The lens can be attached, for example, by a silicone layer 10 to the housing. The silicone layer is preferably comprised of an optical silicone adapted to allow light to pass through the silicone unhampered.

Figure 2:
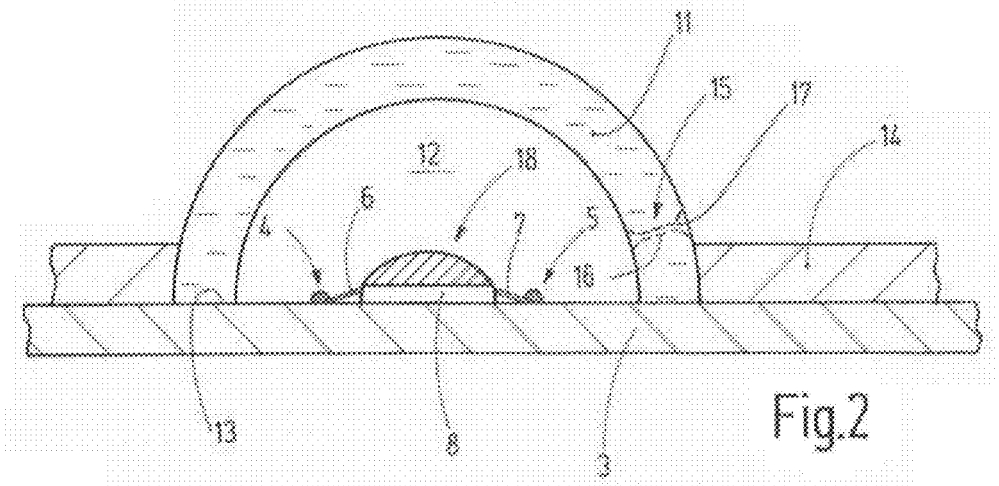
FIG. 2 is a partial cross-sectional side view of a second embodiment of the present invention.

Referring to FIGS. 1 and 2, the LED component 2 is surrounded and encapsulated by a cover 11. The cover is shaped, for example, like a dome, and defines an interior space 12 between the inner peripheral surface of the cover, the housing 8 and lens 9 if so provided. The bottom edge 13 of the cover is preferably placed directly on and connected to the support 3. A sealing layer 14, which is preferably comprised of a polyurethane or similar material, can be used to attach the cover to the base and to also seal the LED component from the external environment. The cover 11 may also be formed of a polyurethane or other desired heat-resistant plastics such as Polymethyl Methacrylate or Polycarbonate, for example.

A vent device 15 is formed in a desired location within the cover 11. The vent device serves as a path for outgases to escape from the LED module assembly, and in particular those gases arising from the heating of the solder pads and flux used to affix the LED chip and die to the housing 8 and the support 3 during operation of the LED, which may then be present within the interior space 12. The vent device 15 is constructed such that it will not permit either air or water vapor to penetrate into the interior space 12 from outside of the cover 11. The vent device is preferably formed by a straight channel 16 defined within and extending through the cover 11, as illustrated. The channel is filled with a plastic material 17 that is permeable to harmful gases, including those which may be held within the interior space 12.

The plastic material 17 is preferably comprised of a crosslinked silicone plastic, again preferably an optical silicone so as not to diminish the optical performance of the LED module. The silicone plastic provides a diffusion path to the outside for hydrocarbons. The molecules of any harmful gases that diffuse on the inside of cover 11 can pass through the plastic material 17 and exit into the air outside of the cover 11. Water molecules, however, cannot pass through this plastic material 17 and into the interior space 12.

The refractive index of this optical silicone is preferably the same as the refractive index of the material used to form the cover 11. So formed, the plastic material is optically invisible and will not otherwise interfere with light passage through the cover. The ends of the channel may also be widened or tapered inward and/or outward in funnel-like fashion, as shown in FIGS. 1 and 2.

As known, during operation of the LEDs significant heating of the LED component 2 and the support 3 can occur. The formation of harmful gases can also occur as a result of this heating, for example, flux residues are heated as the assembly heats up which in turn causes trapped gases or vapors to be released from the residues into the interior space 12. These gases may comprise organic compounds which have a significant reactivity, and in particular can have an acid reaction which would damage the LED assembly if the gases remained trapped within the interior space 12. Before these harmful gases can have a detrimental effect on the silicone layer 10 and fog same, however, the gases will escape through the vent device from the interior space out through the plastic material 17. This protects the silicone layer 10 used to affix the lens or optic 9 from being damaged, for example from being etched, clouded or fogged, all of which will in turn degrade the optical output or optical quality of the LED module caused by light otherwise being scattered in the silicone layer 10.

FIG. 2 illustrates an alternate embodiment of the vent device 15, which is shown positioned within a side portion of the cover 11, outside of the optical path. In this embodiment of the LED module a silicone drop or blob 18 is provided instead of a lens 9 on the housing 8 and acts to close off the housing relative to the cover 11. Otherwise, this embodiment of the LED assembly is constructed in the same fashion as that described above.

Figure 3:
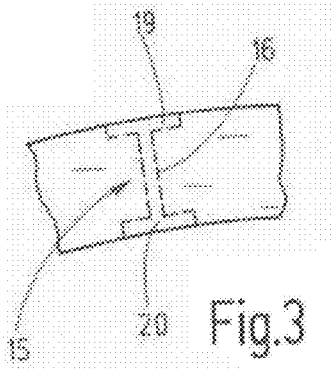
FIG. 3 is a partial cross-sectional view of an embodiment of yet another embodiment of the vent device of the present invention.

FIG. 3 illustrates another embodiment of the vent device 15. Here, instead of being formed with funnel-like openings at the ends of the channel 16, the channel has flattened zones 19, 20 at its proximal and distal ends, these zones serving as an inlet and an outlet, respectively, for any harmful gases which may be present within the interior space 12. The relatively large surface area of zone 20 is sufficient to permit any harmful gas molecules which may be present to pass through the vent device and thus be vented from the interior space of the LED module.

Figure 4:
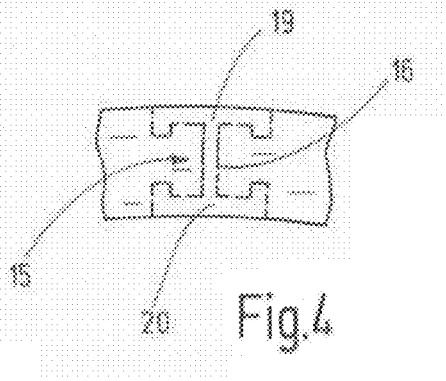
FIG. 4 is a partial cross-sectional view of yet another embodiment of the vent device of the present invention.

Another alternate embodiment of the vent device 15 is illustrated in FIG. 4. In this embodiment the zones 19 and 20 at the ends of the channel 16 are further deepened in the vicinity of their edges within the cover 11 in order to further improve waterproofing. This is achieved by providing more surface contact and therefore better adhesion between the two materials while also creating a more difficult path for moisture to enter the module should the adhesion fail at any point along the surfaces.

Figure 5:
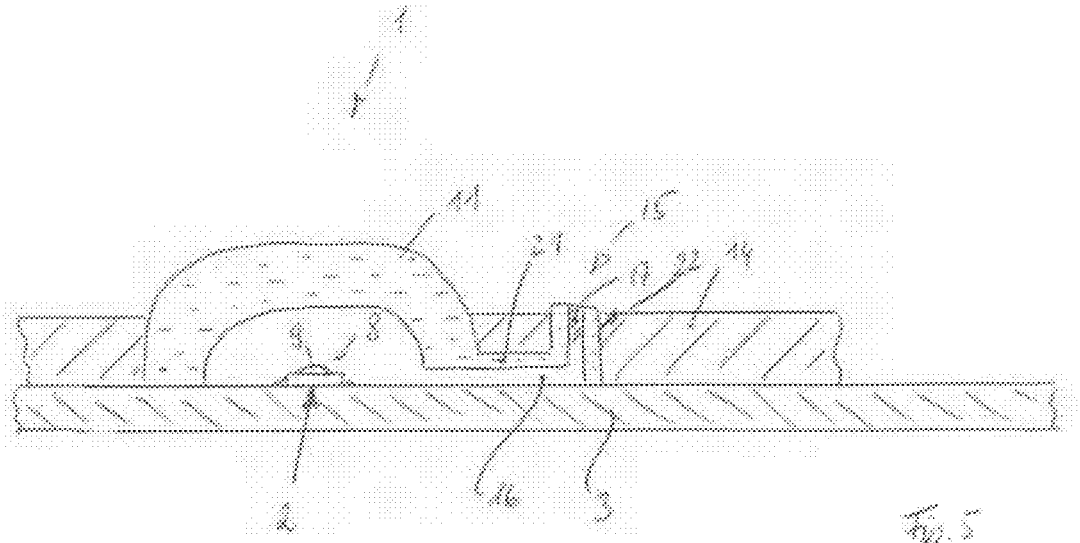
FIG. 5 is a partial cross-sectional elevational view of an additional embodiment of the present invention formed around a LED component assembly.

Another embodiment of the LED module is shown in FIG. 5, in which the channel 16 serving as a vent is placed at the side of the cover 11. The cover, for this purpose, has a continuation 21 which preferably extends away from a central portion thereof in a radial direction, and which preferably extends along a portion of the support 3. The continuation defines the channel 16, which is formed relative to the support 3, as shown. The continuation is entirely enclosed within and covered by a sealing mass or layer 14, as discussed above. A cylindrical boss 22 extends from the end of the continuation 21 and has an upper end which protrudes out of the sealing layer 14. The continuation 21 and the boss 22 together form the vent device 15 in this embodiment of the LED module assembly. The channel 16 extends through the cylindrical boss and out through the top of the boss and thus out of the LED module assembly. As desired the channel 16 can be open, fully closed or closed by means of the plastic material 17 placed in the channel.

Figure 6:
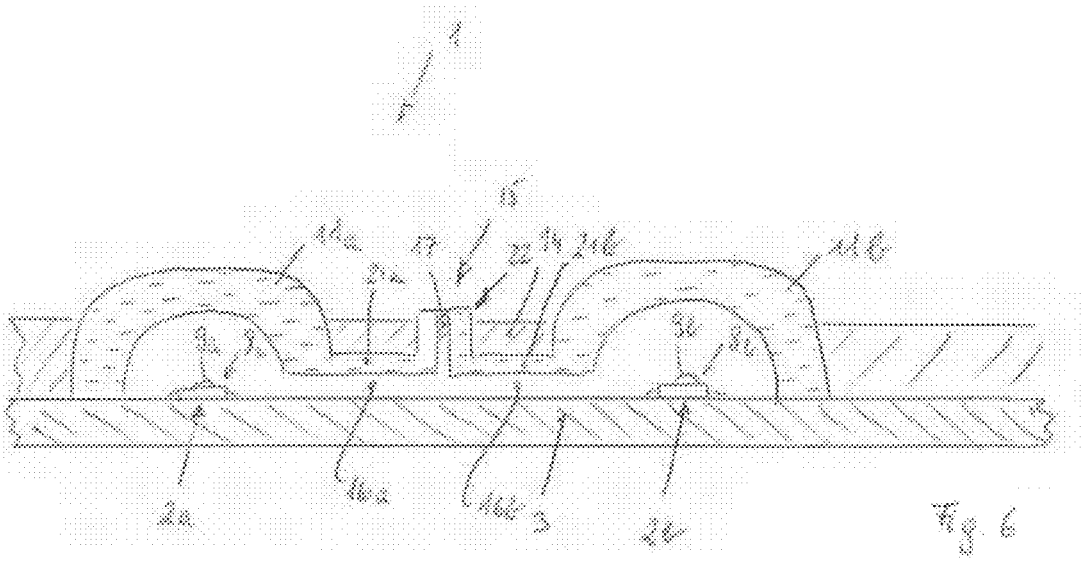
FIG. 6 is a partial cross-sectional elevational view of another embodiment of the present invention formed around LED component assemblies.

As shown in FIG. 6, a plurality of LED components 2*a*, 2*b* and their respective covers 11*a*, 11*b* thereof can also be vented with through a common vent device 15. The bosses 22 can be connected via separate continuations 21*a*, 21*b* to two or more covers 11*a*, 11*b* in which channels 16*a*, 16*b* connect to the common hole in the boss 22.

In each of the embodiments of the LED module assembly, in which the channel 16 is placed outside of the optical light path, a vent closure could be utilized which was non-transparent. A non-transparent vent closure may be constructed of the plastic material 17 to allow for the escape of the damaging gases, or an alternate vent mechanism could be used such as a venting valve (not illustrated).

As shown, therefore, in an LED module assembly having LED components covered by a transparent cover, any gases which might be present within the interior space and which might also damage the LED components are vented to atmosphere through the vent device. The vent device is constructed to prevent the entry of moisture into the interior space by the addition of the plastic material placed within the channel 16 of the vent device, the plastic material however also permitting harmful/damaging gases to escape the LED module assembly. In this manner damage to the LED components, and particularly damage by fogging, discoloration, overheating and the like to the silicone elements or layers of the assembly which are adapted to permit light passage therethrough is prevented.

Although preferred embodiments of the invention have been disclosed herein, it is anticipated that numerous other embossment patterns with non-collinear edges and formed in a side or the opposing sides of a single structural panel, or within a series of spaced or stacked panels may be formed, and thus the drawings and description of the invention should not be viewed as limiting the intended scope of the invention.

REFERENCE NUMBERS

1 LED Module assembly
2, 2*a*, 2*b* LED component
3 Support or Printed Circuit Board
4, 5 Soldering pads
6, 7 Connection pins
8, 8*a*, 8*b* Housing
9, 9*a*, 9*b* Lens
10 Silicone layer
11, 11*a*, 11*b* Cover
12 Interior space
13 Edge
14 Sealing layer
15 Vent device
16, 16*a*, 16*b* Channel
17 Plastic material
18 Silicone blob
19, 20 Zones
21, 21*a*, 21*b* Continuation
22 Boss

We claim:

1. An LED module assembly for venting gases arising from the operation of the assembly, the LED module assembly having a support on which at least one LED component is mounted with an optically transparent cover which surrounds and encloses the at least one LED component on the support, and a vent device constructed and arranged to vent an interior space of the LED module assembly defined by the support and the cover for venting the gases from the interior space out to atmosphere, wherein the assembly further comprises a moisture barrier material positioned at least partially within the vent device.

2. The LED module assembly of claim 1, further comprising a plurality of solder pads used to affix the at least one LED component to the support.

3. The LED module assembly of claim 1, where said at least one LED component has a primary optic.

4. The LED module assembly of claim 3, where said primary optic is constructed of a silicone based plastic material.

5. The LED module assembly of claim 1, where the cover is created from one of a polymethyl methacrylate, a polyurethane, a glass or a polycarbonate.

6. The LED module assembly of claim 1, further comprising a sealing layer which is applied to the support and seals the edges of the cover to the support to encapsulate the at least one LED component in a substantially air-tight manner.

7. The LED module assembly of claim 6, wherein the sealing layer comprises one of a polyurethane, a Silicone or a similar material.

8. The LED module assembly of claim 1, where the vent device comprises a channel defined within and extending through the cover from the interior space out to atmosphere.

9. The LED module assembly of claim 1, the moisture barrier material comprising a vapor-tight plastic.

10. The LED module assembly of claim 1, the moisture barrier material comprising an air-tight plastic.

11. The LED module assembly of claim 1, the moisture barrier material being comprised of a silicone based material.

12. An LED module assembly for venting outgases arising from the operation of the assembly, the LED module assembly having a circuit board on which at least one LED component is mounted and an optical element which encloses the at least one LED component on the circuit board with an air-tight seal and defines an interior space between the circuit board and the optical element, and a gas permeable vent defined within the optical element such that any outgases from the at least one LED component or the PC board which are captured within the interior space of the LED assembly are permitted to vent out into the atmosphere.

13. The LED assembly of claim 12, the vent comprising a channel defined within the optical element and extending from the interior space to atmosphere, and a gas permeable sealing material substantially closing said channel so that moisture may not freely pass through the sealing material.

14. An LED assembly for venting outgases arising from the operation of the assembly, the LED assembly comprising:

a circuit board;

at least one LED component mounted on the circuit board;

an optical element enclosing the at least one LED component on the circuit board, the optical element forming an air-tight seal about the at least one LED component and defining an interior space between the circuit board and the optical element;

an elongate channel defined within the optical element and extending from the interior space to atmosphere; and a moisture resistant gas permeable sealant placed in the channel whereby any outgases within the interior space are permitted to vent out to atmosphere and so that moisture may not freely pass through the sealant.

15. The LED assembly of claim 14, further comprising a primary optic mounted on the at least one LED component.

16. The LED assembly of claim 15, the optical element comprising a secondary optic.

* * * * *